US005588265A

United States Patent [19]

Gill

[11] Patent Number: 5,588,265

[45] Date of Patent: Dec. 31, 1996

[54] EARTHQUAKE PROTECTIVE STRUCTURE

[76] Inventor: Danny A. Gill, 1428 Mt. Pleasant St., Los Angles, Calif. 90042

[21] Appl. No.: 297,264

[22] Filed: Aug. 26, 1994

[51] Int. Cl.[6] ..... E04H 9/00

[52] U.S. Cl. ..... 52/167.1; 52/79.9; 52/86; 52/204.2; 52/656.4

[58] Field of Search ..... 52/204.1, 204.2, 52/210, 211, 79.7–79.9, 79.12, 86, 90.1, 741.3, 656.4, 167.1, 167.3, 85, 206

[56] References Cited

U.S. PATENT DOCUMENTS

| | | | |
|---|---|---|---|
| 1,619,631 | 3/1927 | Patasnik | 52/86 X |
| 2,281,864 | 5/1942 | Toothacre | 52/210 |
| 2,326,549 | 8/1943 | Miller | 52/204 X |
| 2,863,534 | 12/1958 | Gillespie | 52/204.1 X |
| 2,918,153 | 12/1959 | Hammitt et al. | 52/204.1 X |
| 2,939,185 | 6/1960 | Ader et al. | 52/204.1 X |
| 3,802,133 | 4/1974 | Gregory | 52/86 |
| 4,228,630 | 10/1980 | Englert et al. | 52/211 X |
| 4,301,632 | 11/1981 | Wagner | 52/86 X |
| 4,400,917 | 8/1983 | Massaro et al. | 52/86 |
| 4,693,634 | 9/1987 | Chiaves | 52/86 |
| 4,955,168 | 9/1990 | Barry | 52/210 |
| 5,295,327 | 3/1994 | Dubois | 52/211 X |

FOREIGN PATENT DOCUMENTS

| | | | |
|---|---|---|---|
| 7401850 | 8/1975 | France | 52/204.1 |
| 2516584 | 5/1983 | France | 52/204.1 |

*Primary Examiner*—Robert Canfield
*Attorney, Agent, or Firm*—Albert O. Cota

[57] ABSTRACT

An earthquake protective structure (10) that consists of a first side section (12), a second side section (14), an upper section (16) that is attached to the upper ends (12A,14A) of the two side sections and a base plate (18) that attaches to the lower ends (12B,14B) of the two side sections. The structure (10) is designed to be incorporated into a door jam (60), various sizes of building portals (66) and within the confines of hallways or passageways (72). The structure (10) is sized to allow one or more persons to stand under the structure (10) during a seismic event. Thus, the person(s) under the structure (10) are protected from falling debris resulting from the seismic event.

9 Claims, 5 Drawing Sheets

EARTHQUAKE PROTECTIVE STRUCTURE

TECHNICAL FIELD

The invention pertains to the general field of earthquake safety devices and more particularly to a protective structure that is attached around a door frame or portal under which a person can stand to be protected from falling debris resulting from an earthquake.

BACKGROUND ART

In most conventional designs of single or multi-storied buildings and residential dwellings, the movement of the foundation and the subsequent response of the building which results from the occurrence of an earthquake have been calculated to utilize varying structural and architectural appointments designed to protect the building and occupants therein.

Prior art earthquake-resistive methods include the use of laminated rubber supports and dampers interposed between a building, its foundation, and the various elements which comprise the internal structure: seismic energy-absorbing building members designed to fall upon the impact of seismic stress and building flex enhancement means provided by slits in walls, support columns and the like. Additionally, internal supports in areas subjected to higher stress, such as doorways and room perimeters are incorporated to aid in the maintaining of structural stability and rigidity.

In the event an earthquake or other comparable seismic motion occurs, the safety of buildings designed according to prior earthquake-resistive designs depends on several fundamental concepts, which include, but are not limited to: the energy that is absorbed due to hysteresis characteristics and the plasticization of structures which exceed the seismic energy that acts upon the structure's internal design elements.

Conventional methods further provide some measure of quake resistance which are passive to natural external forces. These forces result, either directly or indirectly, from earthquakes, seismic motion(s), wind or the like. Therefore, due to a building's specific natural frequency, the resonance phenomena resulting from the aforementioned forces and a building's response to such cannot be avoided. The actual effect(s) are uncertain and unpredictable but predominantly adverse to the building's structural integrity and the occupant's general safety.

Thus, the need fop an earthquake protective cover under which a person or persons can stand during an earthquake is needed to assure safety. A search of the prior art did not disclose any patent that specifically disclose the earthquake protective cover of the instant invention. However, the following two patents are considered related:

| PATENT NO. | INVENTOR | ISSUED |
|---|---|---|
| 5,111,543 | Epshetsky, et al | 12 May 1992 |
| 5,072,570 | Johnson | 17 December 1991 |

The 5,11,543 Epshetsky, et al patent discloses a method for providing earthquake reinforcement for existing wood frame buildings. The method consists of providing two truss members. The first member secures the building to the foundation and the second member prevents the building cripple walls from collapsing during an earthquake. The first truss member includes structural elements and is joined to the concrete foundation. The second truss member includes a lower L-shaped beam that is bolted to an adjacent L-shaped beam located on the first truss member.

The 5,072,570 Johnson patent discloses a bed with a foldable earthquake protective cover. The cover consists of a support frame and two movable members pivotally attached to the support frame. The movable members can be pivoted between a folded position and an unfolded position in which they form a rigid cover above the bed's occupants.

For background purposes and as indicative of the art to which the invention is related reference may be made to the remaining cited patents.

| PATENT NO. | INVENTOR | ISSUED |
|---|---|---|
| 4,922,667 | Kobari, et al | 8 May 1990 |
| 4,858,738 | Novoa | 22 August 1989 |
| 4,522,000 | Barari | 11 June 1985 |

DISCLOSURE OF THE INVENTION

The earthquake protective structure is designed to add strength, stability and rigidity to existing door jams, portals and passageways located on dwellings and other occupied buildings. In its most basic design, the earthquake protective structure consists of:

A. A first side section having an upper end, a lower end, an inward surface, an outward surface, a front end and a rear end.

B. A second side section having an upper end, a lower end, an inward surface, an outward surface, a front end and a rear end; and C. An upper section having a first side end, a second side end, an inward surface, an outward surface, a front end and a rear end. The first side end is attached by an attachment means, to the upper end of the first side section. Likewise, the second side end is attached by an attachment means to the upper end of the second side section. The structure is designed to be incorporated into one or more of the above building structures, and is sized to allow at least one person to stand under the structure to protect the person from falling debris resulting from an earthquake.

Although additional structural support is provided in areas such ad doorways, per building and construction codes, the massive force exerted upon a doorway and its surrounding structure, during an earthquake does not compensate, to a sufficient extend, to ensure the necessary stability of the building and safety of the occupants therein during an earthquake of sufficient magnitude.

The invention provides the additional requisite amount of strength, stability and rigidity which enables a building to compensate for the destructive forces exerted on the building by earthquake, seismic motions and/or other similar natural or un-natural incidents. Previously, door frames in particular have been designated as the preferred location in a home, office or other such dwelling to offer the safest refuge during the occurrence of an earthquake.

The logic and reasoning which serve as the basis for the selection of a doorway as a "safe-place" were well-founded, and, compared with other areas of a home or office, a conventional doorway does not offer a greater degree of protection against the various harmful occurrences which result from an earthquake. Unfortunately, once a certain level of destructive force is exerted, the conventional door jam, surrounding the doorway will be unable to withstand the ensuing pressure and failure to protect any person(s) who are relying on such protection is imminent.

Previously, there have been attempts made to add on to, or improve various structural and non-structural designs, with the emphasis being on providing additional strength to compensate fop the destructive forces being exerted. Whereas many of these additions and/or improvements do offer a greater degree of protection, none directly address door jams, portals and passageways as does the instant invention.

In view of the above disclosure, it is the primary object of the invention to provide an earthquake protective structure that:

A. is easily attached to a newly constructed or existing door jam, portal or passageway, and B. that when so attached, allows at least one person to stand under the structure and be protected from falling debris resulting from an earthquake.

In addition to the primary object, it is also an object of the invention to provide an earthquake protective structure that:

provides the additional support and strength during seismic incidents when normal strength or even some additional methods of adding such strength are insufficient to provide the necessary building support;

although the additional structural strength and support may never be required, the inventive structure adds to the overall general structural safety and strength of the dwelling, is adaptable to maintain structural members rigid, resistant to forces of compression, resistant to forces of tension; or selectively resistant to forces of compression and/or tension. By placing the inventive structure in a strategic manner on key structural members, i.e., the door jam of a door they will adapt to control the rigidity of the door to withstand the destructive forces of vibration which are caused by the seismic incidents and, can be manufactured in various heights, depth and widths to be attached to various size and shapes of building structural elements.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
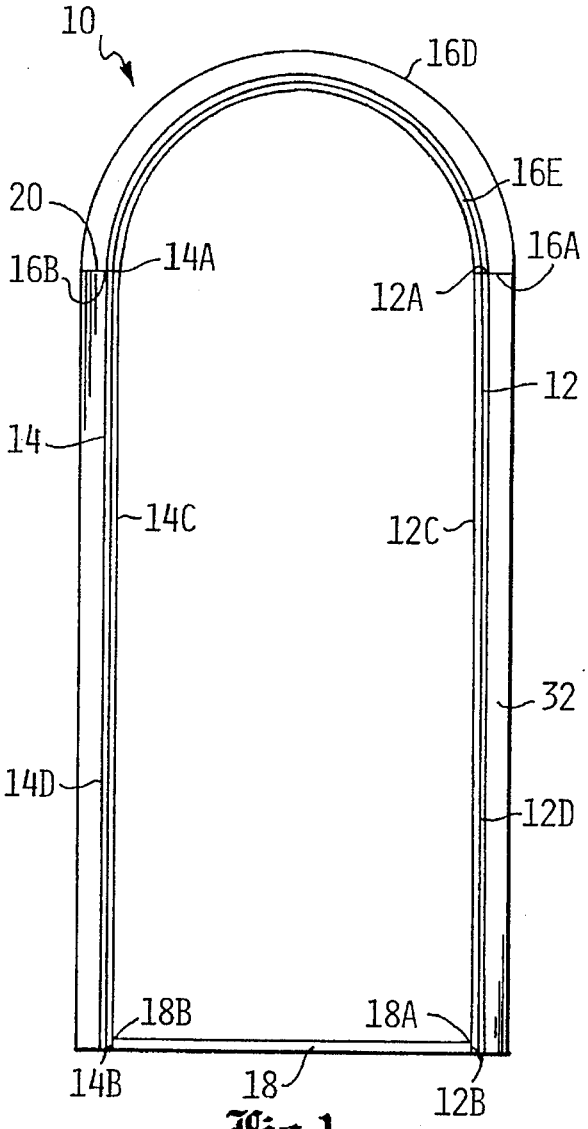
FIG. 1 is a front elevational view of the earthquake protective structure shown with an arched upper section, and a pair of angle iron supports around a first and second side sections and the upper section.

The best mode for carrying out the earthquake protective structure 10 is presented in terms of a preferred embodiment that is presented in various methods of attaching the structure to selected areas of a single-family residence or other inhabited buildings.

The structure when attached, allows at least one person to stand under the structure to avoid falling debris resulting from an earthquake. The preferred embodiment as shown in FIGS. 1–19 is comprised of the following major elements: a first side section 12, a second side section 14, an upper section 16, a base plate 18 and at least two angle iron supports 32.

The first and second side sections 12,14 as well as the base plate are preferably constructed 0.25 inch (0.635 cm) "black iron" steel plate and the angle iron supports are preferably drawn from "black iron" and are 3 by 3 by 0.375 inches (7.62×7.62×0.953 cm). This size of angle iron supports is particularly suitable to accommodate the 2 by 4 inch wood stud construction used in most North American single family residences.

Typically, the structure 10 has a height of 96 inches (244 cm), a width from between 28 to 36 inches (71 to 91 cm) and a depth of 24 inches (61 cm). The depth of the structure 10 in the preferred embodiment is 24 inches (61 cm). This width can easily accommodate and protect two adults and one small child. However, the width can be any size and is only limited by the location where the structure 10 is to be attached.

Figure 2:
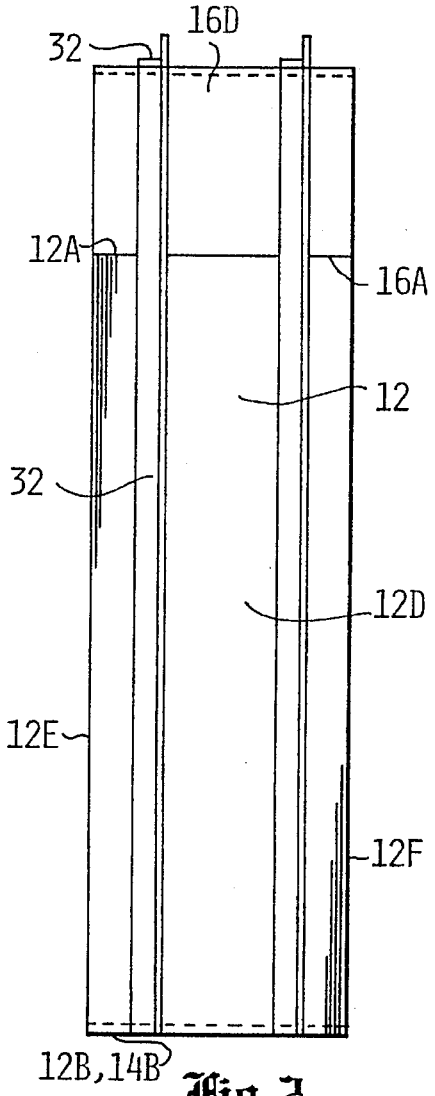
FIG. 2 is a right-side elevational view of the structure shown in FIG. 1.
Figure 3:
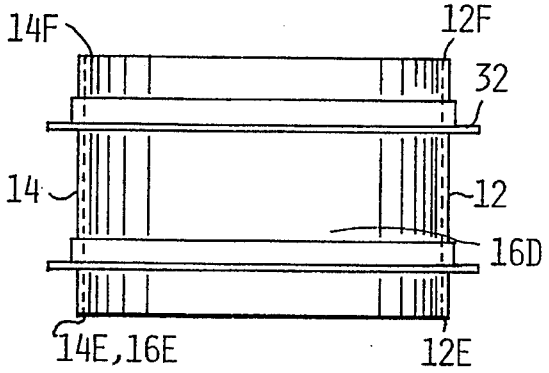
FIG. 3 is a top plan view of the structure shown in FIG. 1.
Figure 4:
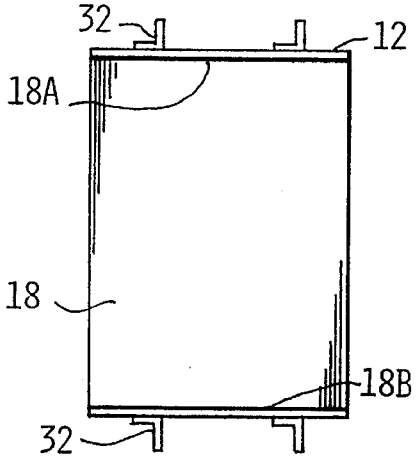
FIG. 4 is a bottom plan view of the structure shown in FIG. 1.

The first side section 12 as shown in FIGS. 1–4 is comprised of an upper end 12A, a lower end 12B, an inward surface 12C, an outward surface 12D, a front end 12E and a rear end 12F. Likewise, the second side section 14 as shown in FIGS. 1, 3 and 4, is comprised of an upper end 14A, a lower end 14B, an inward surface 14C, an outward surface 14D, a front end 14E and a rear end 14F.

Figure 5:
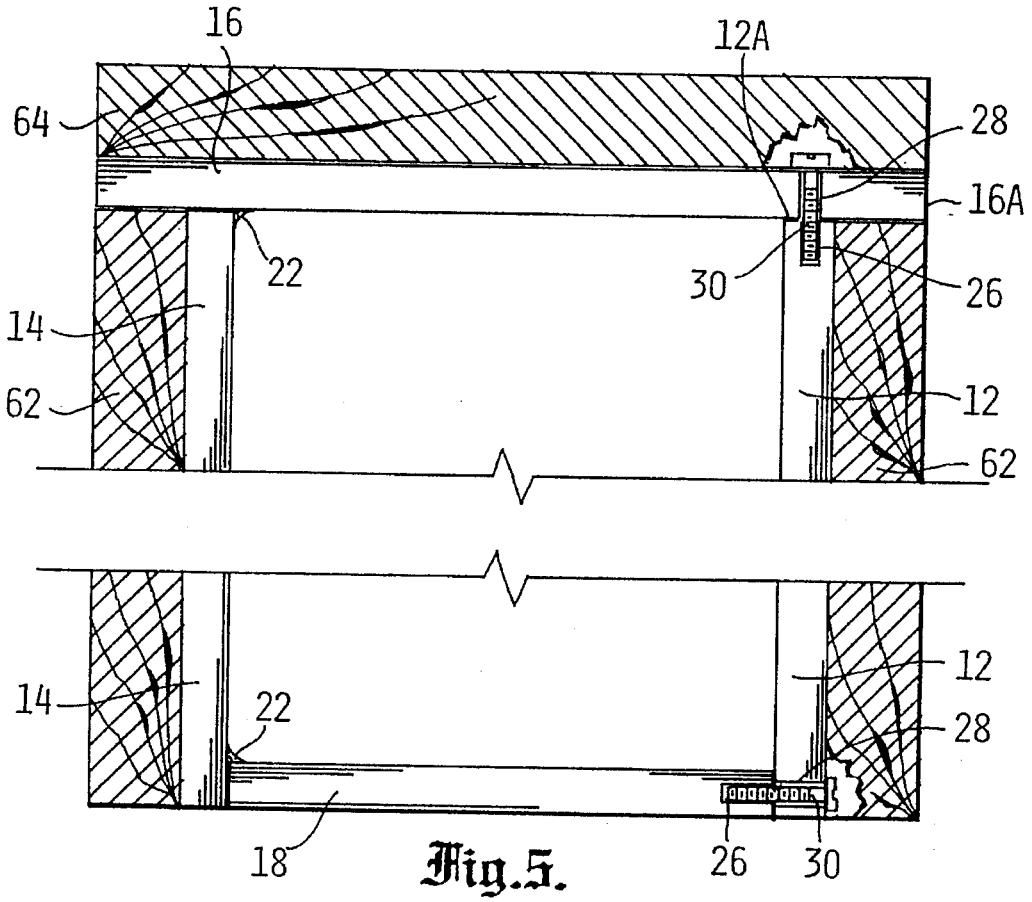
FIG. 5 is partial, front elevational view of a structure that incorporated a flat upper section.
Figure 6:
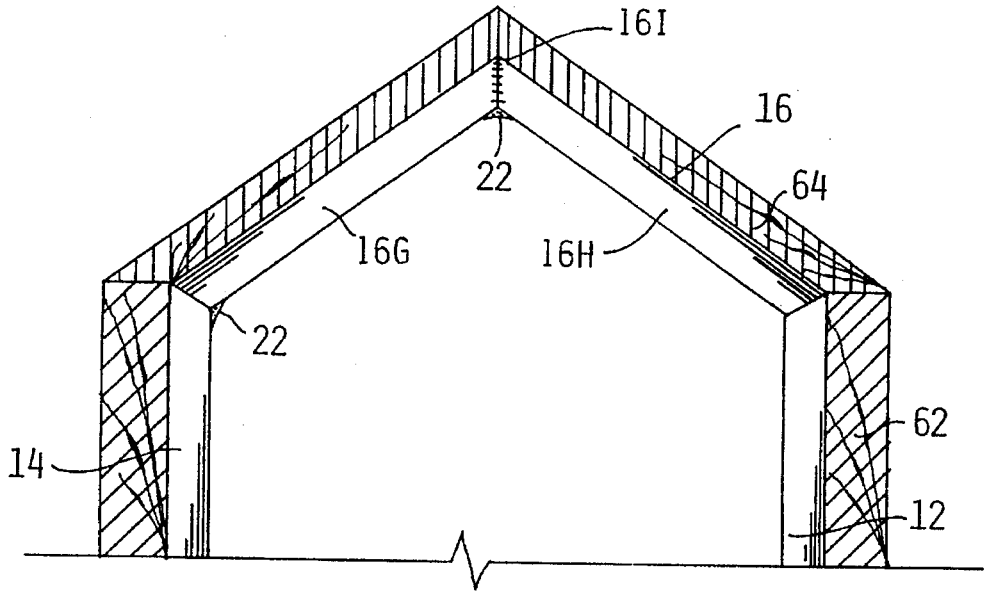
FIG. 6 is a partial, front elevational view of a structure that incorporates a triangular upper section.

The upper section 16 as shown in FIGS. 1–3 includes a first side end 16A, a second side end 16B, an inward surface 16C, an outward surface 16D, a front end 16E and a rear end 16F. The first side end 16A is attached by an attachment means 20, to the upper end 12A of the first side section 12. Likewise, the second side end 16B is attached to the upper end 14A of the second side section 14. As shown in FIG. 1, the upper section 16 is preferably configured in the form of an arch. However, as shown in FIG. 5, the upper section may also be flat, or as shown in FIG. 6, the upper section 16 may be configured in the form of an upward extending angle. Preferably, the angular shaped upper section 16 is constructed of two legs: a first leg 16G and a second leg 16H. As shown in FIG. 6, the two legs are preferably attached at the an apex 16I by a welding process 22 or the like. The angle of the triangle is determined by the spacing of the first side section 12 and second side section 14. For optimum strength, when using an upper section 16 in the form of an arch, the width of the structure 10 is equal to two-times the radius of the arch; or in other words, if the arch is equal to one-half of a circle, the width of the structure 10 is equal to the diameter of the circle.

To complete the basic design of the structure 10, the base plate 18 is employed. This base plate is essential to prevent a "tweezer" effect—that is to prevent the lower ends 12B, 14B of the first and second side section 12,14 from bending inward which can be caused by a violent floor shift during an earthquake.

The base plate as shown best in FIGS. 1 and 4, consists of a first side end 18A and a second side end 18B. The first side end 18A is attached by an attachment means 20 to the lower end 12B of the first side section 12. Likewise the second side end 18B is attached to the lower end 14B of the second side section 14.

The means for attaching the upper section 16 and the base plate 18 to the first and second side sections 12,14 is preferably by a welding process 22 as shown in FIG. 5. Alternatively, as also shown in FIG. 5, the upper section 16 can be bolted to the first and second side sections 12,14. In the bolted attachment method, to bolt the upper section 16 to the first and second side sections 12,14 the upper sections have on their upper ends 12A,14A a plurality of threaded bores 26. The upper section 16 has near the first and second side ends 16A,16B a plurality of bolt bores 28 that are in alignment with the threaded bores 26. To fasten the two sections, a plurality of threaded bolts 30 are inserted through the bolt bores 28 and threaded into the threaded bores 26. To fasten the base plate 18 the threaded bolts 30 are preferably inserted from the side as also shown in FIG. 5. To provide optimum safety, grade 8 bolts having a 0.375 inch (0.0953 cm) diameters and attached on 12 inch (30.48 cm) centers is recommended.

To increase the utility and safety provided by the structure 10 at least one hand rail 34 and a utility compartment 36 may be included in the design of the support 10.

Figure 7:
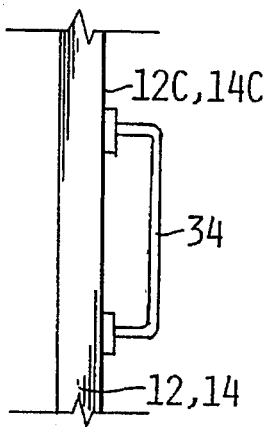
FIG. 7 is a partial, front elevational view of a structure showing a vertically oriented hand rail attached to one of the structure's side sections.
Figure 8:
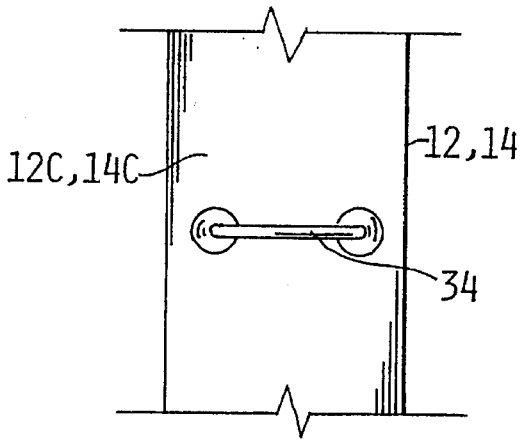
FIG. 8 is a partial, side elevational view of a structure showing a horizontally oriented hand rail attached to one of the structure's side sections.

The hand rail 34 is preferably elongated and is attached by an attachment means to the inward surfaces 12C,14C of the first side section 12 and/or the second side section 14. The hand rails can be vertically attached as shown in FIG. 7, or horizontally attached as shown in FIG. 8.

Figure 10:
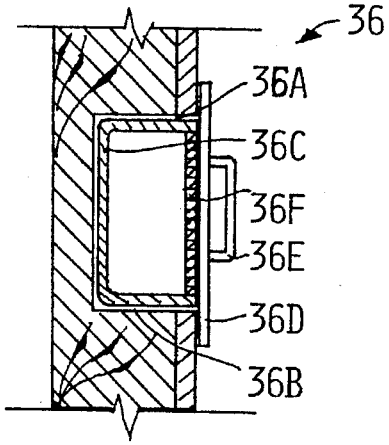
FIG. 10 is a partial, side elevational view of the utility compartment.
Figure 9:
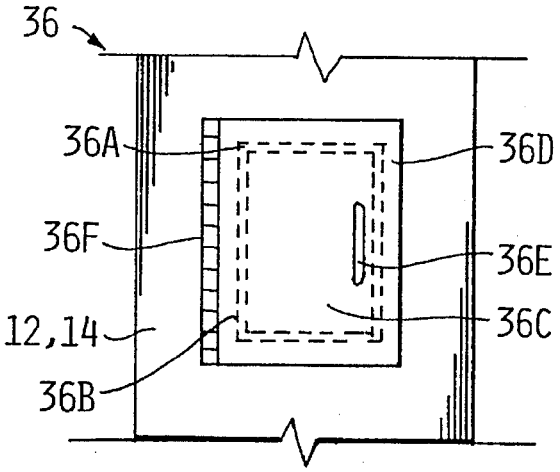
FIG. 9 is partial, front elevational view of a structure that incorporates a utility compartment inserted within one of the structure's side sections.

The utility compartment 36 as shown in FIGS. 9 and 10, is constructed by first cutting an opening 36A into either or both of the side sections 12,14. Into the building wall is cut a recess 36B that is slightly larger than the opening 36A. Into the opening 36A and recess 36B is then inserted a container 36C having a front opening that when inserted into the opening, the peripheral sides of the container 36C are flush with the perimeter of the opening 36A. A door 36D having a handle 36E is then attached to the first or second side sections 12,14 adjacent the opening 36A, by means of a hinge 36F. The utility compartment is used to store emergency supplies as would be needed during an emergency such as an earthquake. These supplies include at least one flashlight, a first aid kit, a small bottle of water, a radio, a whistle and other supplies recommended by police and other like departments or agencies.

To add structural integrity to the earthquake protection structure 10, at least two metal supports such as angle iron supports 32 that include a first leg 32A and a second leg 32B are spaced around the outer surfaces of the upper section 16 and the first and second side sections 12,14 as shown in FIGS. 1–3. Preferably, the spacing of the angle iron is chosen to accommodate the spacing of the studs used in the construction of homes and other inhabited buildings as described infra.

Figure 11:
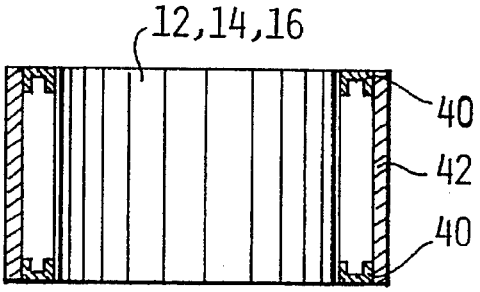
FIG. 11 is a top plan view of a structure that has attached two channel supports to which is attached a sheet metal cover that provides additional structural integrity.

The structural integrity of the structure 10 as described, is considered sufficient to provide a reasonable safety factor. However, if additional structural integrity is desired, the outward surface of the first and second side sections 12,14 and the upper section 16 can have attached by an attachment means, at least two metal supports, such as metal channels 40, as shown in FIG. 11. To these metal channels is then attached by an attachment means a sheet metal cover 42.

The earthquake protective structure is designed to be attached to various structural elements of single family residences or other inhabited buildings. The following describes some of the attachment methods that may be utilized.

Figure 12:
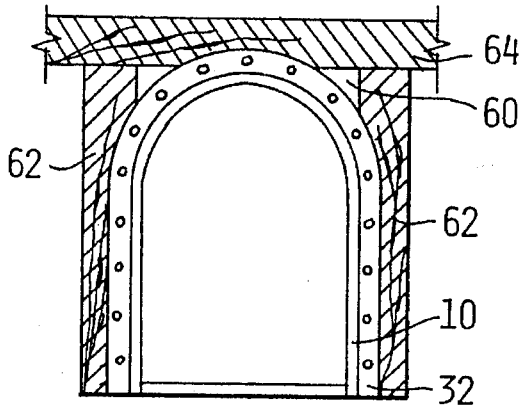
FIG. 12 is a front elevational view showing the structure attached between a door jam.
Figure 13:
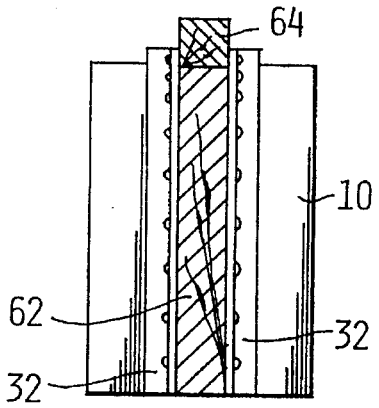
FIG. 13 is a side elevational view showing the structure attached between a door jam.

In the first structure 10 attachment method, the structure is designed and dimensioned to centrally fit into a door jam 60 that is supported by a pair of wall studs 62 and a door header 64 as shown in FIGS. 12 and 13. In this design, the outward surfaces 12D,14D and 16D of the first, second are upward sections 12, 14,16 and pressed against the inside surfaces of the door jam 60 and are attached thereto by an attachment means. The preferred attachment means consists of using a pair of angle iron supports 32 having a first leg 32A and a second leg 32B. The first leg 32A of each angle iron support is attached by an attachment means, such as a welding process, to the outward surfaces of said structure so that the space between the two second legs 32B is sized to accommodate the width of the wall studs 62 and door header 64. on the second leg 32B of the supports 32 is located a multiplicity of bolt bores 28 therethrough into which is inserted a threaded bolt 30 that is threaded into the door jam 60 to thus secure the structure 10.

Figure 14:
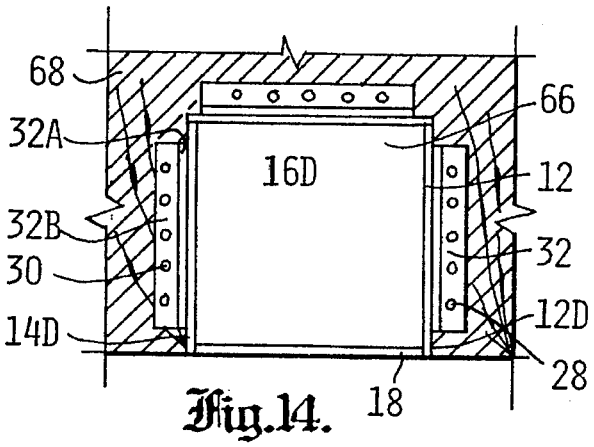
FIG. 14 is a front elevational view showing the structure attached between a building portal.
Figure 15:
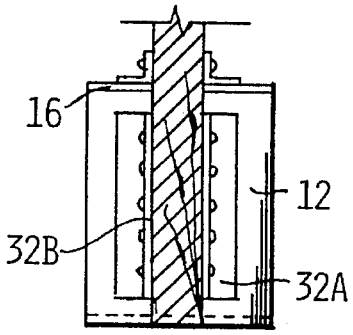
FIG. 15 is a side elevational view showing the structure attached between a building portal.

In the second structure 10 attachment method, the structure is designed to be attached to an existing building portal 66 or a portal that is specifically cut through a building wall to install a structure 10. In this design, as shown in FIGS. 14 and 15, the structure 10 is sized so that the outward surfaces 12D,14D,16D of the first side section 12, second side section 14 and the upper section 16 press against the outward surfaces of the portal 66 and are attached thereto by an attachment means. The preferred attachment means consists of providing an angle iron support 32 having a first leg 32A and a second leg 32B. The first leg 32A is attached by an attachment means, such as a welding process, to the outward surfaces 12D,14D,16D of the structure 10. The second leg 32B has a multiplicity of bolt bores 28 therethrough into which is inserted a threaded bolt 30 that is threaded into the structure of the portal 66. The structure 10 can be attached to the portal by means of an angle iron support 32 attached to only one side of the structure 10 as shown in FIG. 14. However, to further secure the structure 10, both sides of the structure can include angle iron brackets 32 as shown in FIG. 15, that are then attached to both sides of the portal structure.

Figure 16:
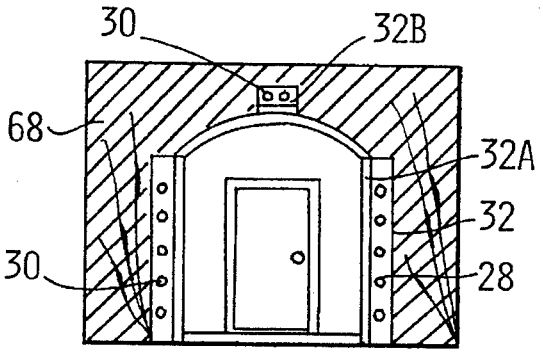
FIG. 16 is a front elevational view showing the structure attached flush against the surface of a wall.
Figure 17:
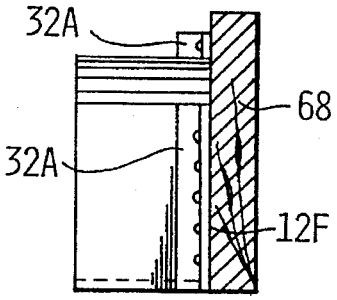
FIG. 17 is a side elevational view showing the structure attached flush against the surface of a wall.

In the third structure 10 attachment method, the structure is designed to be attached flush against the surface of a wall 68 as shown in FIGS. 16 and 17, by an attachment means. The preferred attachment means consists of utilizing an angle iron support 32 having a first leg 32A and a second leg 328. The first leg 32A is attached by an attachment means, such as a welding technique, near the rear end 12F and 14F of the first and second side sections 12,14. The second leg 32B has a multiplicity of bolt bores 28 therethrough into which is inserted a threaded bolt 30 that is threaded into the wall 68.

To provide further attachment security, a small section of an angle iron support 32 can be attached near the center of the upper section 16 as best shown in FIG. 16. As also shown in FIG. 16, the wall used to attach the structure 10 can include an opening having a door 70 that allows entry into an adjacent room or passageway.

Figure 18:
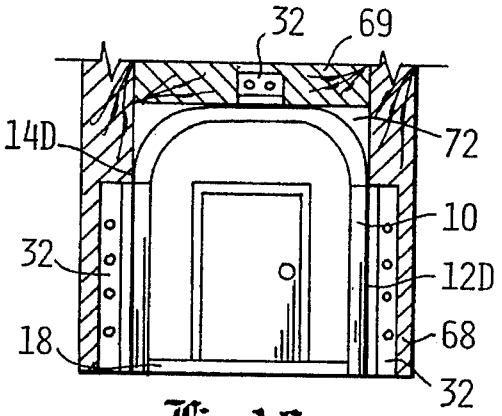
FIG. 18 is a front elevational view showing the structure attached within the confines of a hall or passageway.
Figure 19:
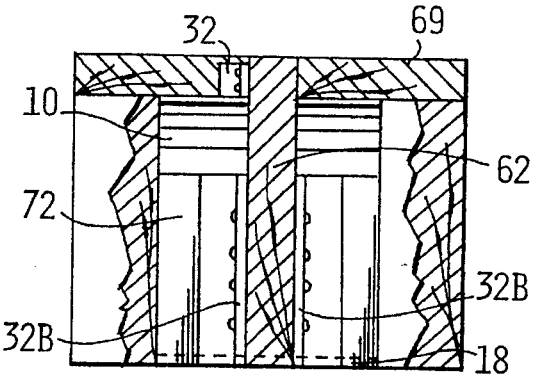
FIG. 19 is a side elevational and cut-away view showing the structure attached within the confines of a hall or passageway.

In the fourth structure 10 attachment method, the structure is designed and dimensioned to be attached within the confines of a hall or passageway 72 as shown in FIGS. 18 and 19. In this design, the structure 10 is dimensioned so that the outward surface 12D,14D of the first and second side sections 12,14 are juxtaposed against the surfaces of the wall 68 and ceiling 69 as best shown in FIG. 18. The preferred attachment means consists of using a pair of angle iron supports 32 having a first leg 32A and a second leg 32B. The first leg 32A of each angle iron support is attached by an attachment means, such as a welding process, to the outward surfaces 12D,14D,16D of the structure 10. The attachment is made so that the space between the two second legs 32B of the supports 32 is sized to receive a wall stud 62 as shown in the cutaway drawing of FIG. 19. The second leg 32A includes a multiplicity of bolt bores therethrough into which is inserted a threaded bolt 30 that is threaded into the wall studs 62 to secure the structure 10. As in the previous attachment method, a small section of angle iron support can be attached near the center to one or both sides of the upper section 16 as shown in FIG. 19.

While the invention has been described in complete detail and pictorially shown in the accompanying drawings it is not to be limited to such details, since many changes and modifications may be made in the invention without departing from the spirit and scope thereof. Hence, it is described to cover any and all modifications and forms which may come within the language and scope of the appended claims.

I claim:

1. An earthquake protective structure attached to one of a door jamb or other portal of a building comprising:

a) a first side section having an upper end, a lower end, an inward surface, an outward surface, a front end and a rear end, b) a second side section having an upper end, a lower end, an inward surface, an outward surface, a front end and a rear end, c) an upper section having a first side end, a second side end, an inward surface, an outward surface, a front end and a rear end, where the first side end is attached by an attachment means, to the upper end of said first side section and the second side end is attached by an attachment means to the upper end of said second side section, d) at least two angle iron supports each having a first leg and a second leg, where said supports are spaced around the outer surface of said upper section and said first and second side sections with the first leg attached to said structure by an attachment means and said second leg surrounding said first and second side sections and said upper section having a multiplicity of bolt bores therethrough where into each of said bolt bores is inserted a threaded bolt that is threaded into said door jamb portal of a building, and e) a base plate having first side end and a second side end where the first side end is attached by an attachment means to the lower end of the first side section, and the second side end is attached by an attachment means, to the lower end of said second side section, where said attached structure is sized to allow at least one person to stand under said structure to protect a person from falling debris resulting from an earthquake.

2. The structure as specified in claim 1 wherein the spacing and orientation of said angle iron supports are chosen so that the second legs of said supports, accommodate the width of wall studs at said door jamb or portal of a building.

3. The structure as specified in claim 2 wherein said structure is dimensioned to fit into a door jam with the outward surfaces of said first and second side sections pressed against an inside surface of said door jamb.

4. The structure as specified in claim 1 further comprising:

a) said first or second side sections having at least one utility opening therethrough, b) said door jam having a recessed area adjacent each utility opening, c) a container having a front opening inserted into a recessed area of a door jam, where when inserted, the peripheral sides of said container are flush with the perimeter of said opening on said first or second side openings, and d) a door, hingedly attached to one side of said first of second side section, where said container is used to store emergency supplies.

5. The structure as specified in claim 1 further comprising at least one elongated hand rail vertically attached by an attachment means to at least one inward surface of said first side section and said second side section.

6. The structure as specified in claim 1 further comprising an elongated hand rail horizontally attached by an attachment means to at least one inward surface of said first side section and said second side section.

7. The structure as specified in claim 1 wherein said structure is dimensioned to fit into a portal that is cut through a building wall, where the outward surfaces of said structure press against an inward surface of said portal.

8. The structure as specified in claim 1 wherein said structure is attached flush against the surface of a wall of a building.

9. The structure as specified in claim 2 wherein said structure is attached to said door jamb or portal such that said door jamb or portal is centrally located between said front and rear ends of said structure.

* * * * *